US006393951B1

(12) United States Patent
Jansson

(10) Patent No.: US 6,393,951 B1
(45) Date of Patent: May 28, 2002

(54) PIPE WRENCH WITH DIFFERENTIATED TOOTH SIZE

(75) Inventor: Conny Jansson, Enköping (SE)

(73) Assignee: Kapman AB, Sandviken (SE)

( * ) Notice: Subject to any disclaimer, the term of this patent is extended or adjusted under 35 U.S.C. 154(b) by 0 days.

(21) Appl. No.: 09/297,582

(22) PCT Filed: Sep. 25, 1997

(86) PCT No.: PCT/SE97/01619

§ 371 (c)(1),
(2), (4) Date: Jul. 7, 1999

(87) PCT Pub. No.: WO98/21012

PCT Pub. Date: May 22, 1998

(30) Foreign Application Priority Data

Nov. 14, 1996 (SE) ..... 9604160

(51) Int. Cl.[7] ..... B25B 13/16
(52) U.S. Cl. ..... 81/167; 81/186
(58) Field of Search ..... 81/165–169, 120, 81/186

(56) References Cited

U.S. PATENT DOCUMENTS

| | | | | | |
|---|---|---|---|---|---|
| 363,901 | A | * | 5/1887 | Marr | 81/165 |
| 459,377 | A | * | 9/1891 | Lind | 81/186 |
| 460,230 | A | * | 9/1891 | Gunnarson | 81/186 |
| 772,751 | A | | 10/1904 | Sorensen | |
| 1,318,454 | A | * | 10/1919 | Kleinkopf | 81/120 |
| 2,847,889 | A | * | 8/1958 | Cain | 81/186 X |
| 3,290,970 | A | * | 12/1966 | DeLucia | 81/165 X |
| 3,631,549 | A | * | 1/1972 | Stoneburg | 81/164 |
| 3,894,451 | A | | 7/1975 | Putsch | |
| 4,831,903 | A | * | 5/1989 | Dausey et al. | 81/165 |
| 4,893,530 | A | | 1/1990 | Warheit | |
| 5,259,281 | A | * | 11/1993 | Burke | 81/120 X |

FOREIGN PATENT DOCUMENTS

| | | |
|---|---|---|
| DE | 2619745 | 11/1977 |
| FR | 2581335 | 11/1986 |
| SE | 179613 | 6/1962 |

* cited by examiner

*Primary Examiner*—D. S. Meislin
(74) *Attorney, Agent, or Firm*—Burns, Doane, Swecker & Mathis, L.L.P.

(57) ABSTRACT

Pipe wrench with two shanks (14,15) each with a toothed jaw (11,12) at an angle to the shank, the shanks, connected at joint (13) and one shank translatable relative to the joint to adjust the distance between the jaws, with the tooth tips on each jaw located in a plane, and the height and pitch distance between teeth monotonously increasing from a small value for teeth (41,42) nearest to the shank up to a larger value for teeth (31,32) farthest from the shank, the increase being at least 25%.

3 Claims, 2 Drawing Sheets

Fig. 1
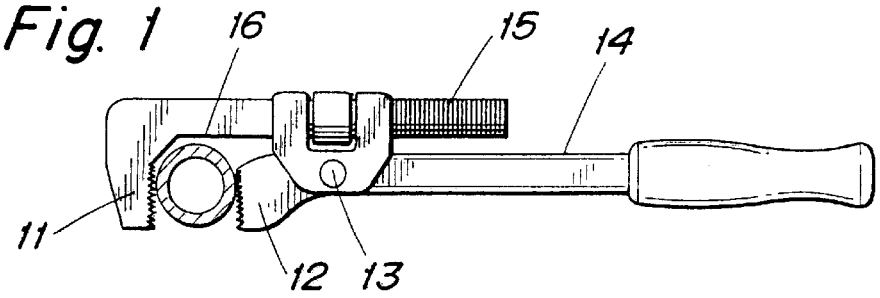
Fig. 2
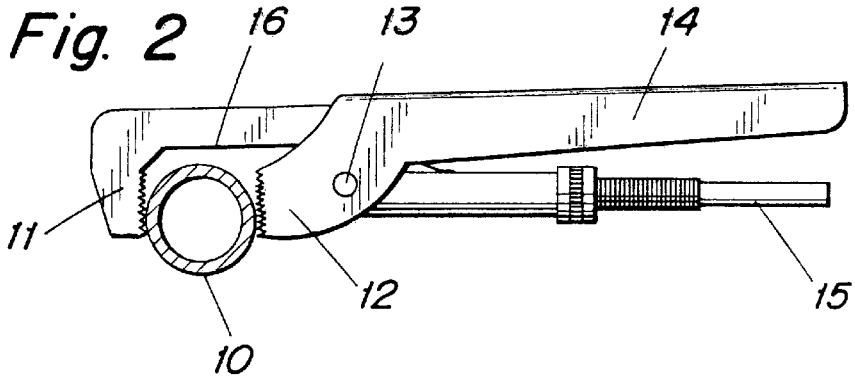
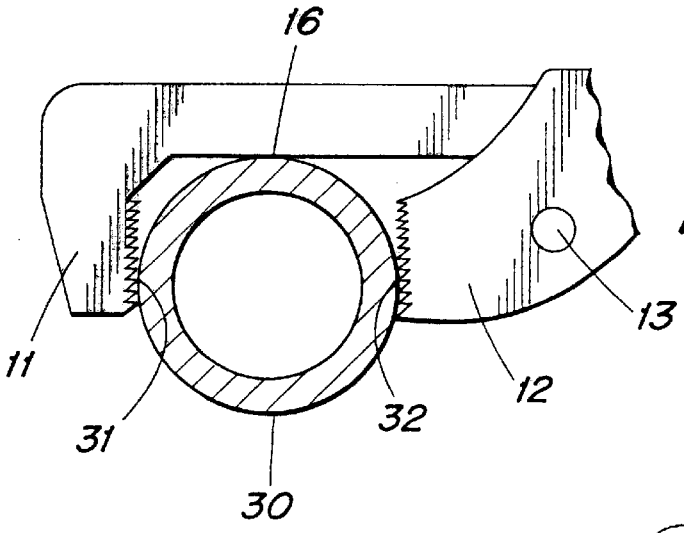
Fig. 3
Fig. 4
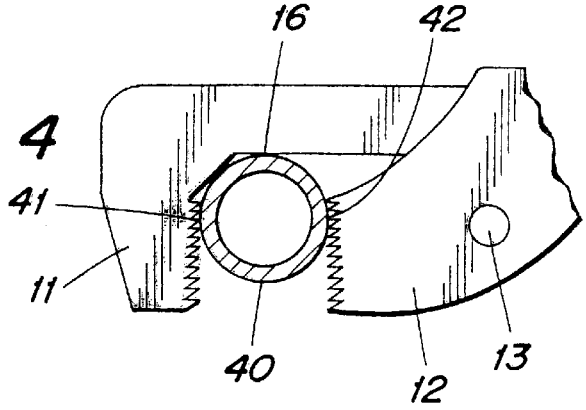

PIPE WRENCH WITH DIFFERENTIATED TOOTH SIZE

BACKGROUND OF THE INVENTION

1. Field of the Invention

The invention concerns an improved type of teeth, better adapted to pipes of varying diameter with less risk of the jaw slipping against the pipe surface with resulting damage.

2. Description of the Related Art

A pipe wrench consists of two shanks with toothed jaws, each jaw extending at an angle of 45–90 degrees from the longitudinal axis of each respective shank. The shanks are connected at a joint, and the joint is fixed relative to the inner jaw, while the outer jaw and its shank can be translated relative to the joint to adjust the gap between the jaws to fit the diameter of the actual pipe or tube to be gripped. The teeth of the jaws serve to give enough friction against the pipe even if there is a surface layer of low strength, such as paint or plastic coating.

BRIEF DESCRIPTION OF THE DRAWINGS

Pipe wrenches according to the invention are described with reference to the drawing figures, wherein FIG. 1 illustrates an American type of wrench having one long and one short shank;

FIG. 2 is a European type of wrench having two long shanks;

FIG. 3 shows jaws according to the present invention gripping a pipe with a large diameter;

FIG. 4 shows jaws according to the present invention gripping a smaller diameter pipe.

DETAILED DESCRIPTION OF THE INVENTION

Figure 5:
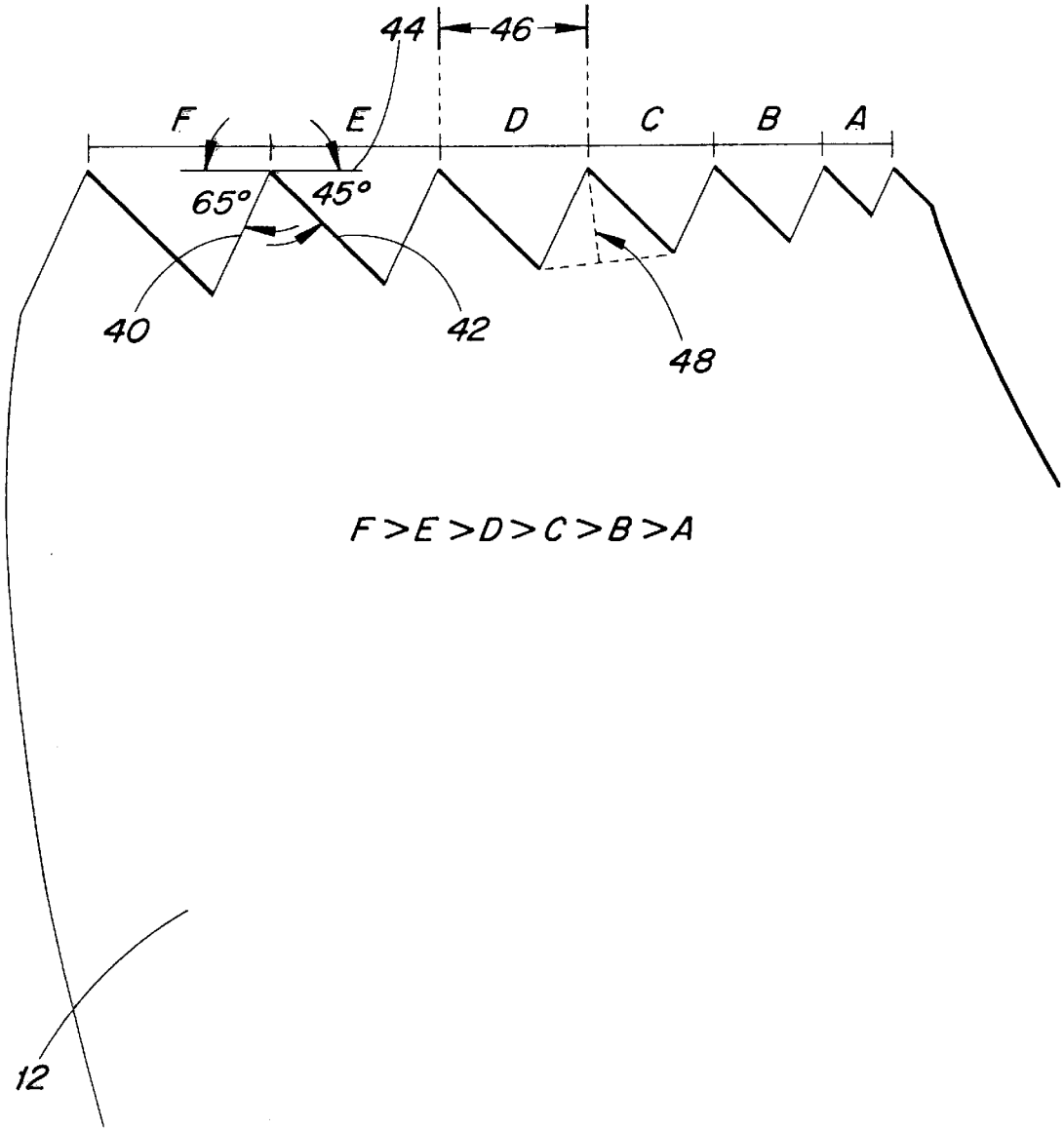
FIG. 5 shows a tooth of a jaw having a leading tooth flank and a trailing tooth flank.

When a pipe wrench grips a pipe (10), the outer jaw (11) and the inner jaw (12) are pressed against the pipe with basically the same radial force, while the tangential force is larger at the inner jaw than at the outer, depending on the different angles from the joint (13) where the shanks (14,15) meet to the contact points at the jaws. When trying to rotate the pipe, a force is applied to the shank (14) of the inner jaw, and the inner jaw will normally slip before the outer jaw. The pipe will then roll against the outer jaw until it touches the inside (16) of the shank (15) of the outer jaw. For each pipe diameter there will finally be one characteristic contact point on each jaw. A pipe with large diameter (30) will have final contact with teeth (31,32) at a large distance from file inside (16), and a smaller diameter pipe (40) will have final contact with teeth (41,42) at smaller distance from the inside.

The jaws have teeth in order to penetrate surface layers on the pipe to get a secure grip. The teeth should preferably be unsymmetrical and leaning in the direction of the pipe is to be turned. The height and sharpness of the teeth and distance between adjacent teeth should be such that two or three teeth touch the pipe at each jaw contact. A single tooth contact is unstable, with indeterminate angle, and a four teeth contact will not securely penetrate the surface layers. Pipe wrenches according to known techniques have teeth of equal height, and their height and distance between adjacent teeth are compromises between what is optimal for different diameters.

According to the invention, the teeth should have different sizes adjusted to the diameter of that pipe which will touch the teeth and the inside (16) at the same time. Accordingly, teeth (41, 42) near the inside (16) should be small in height and close in distance, the teeth far from the inside should be large in height with greater distances between them. The largest tooth should have a height and distance between it and its adjacent tooth at least 25% larger than the height of the smallest tooth and distance between the smallest teeth, preferably 35–40% larger. The distance between adjacent teeth is the distance between corresponding points on adjacent teeth. The tooth size and distance between adjacent teeth could be varied continuously or in steps.

The teeth should preferably be made unsymmetrically in known manner by making the leading tooth flank 40 leaning 65 degrees and the trailing flank 42 angled 45 degrees from the plane 44 of the jaw. The tooth tips should be at the same level to facilitate gripping of polygonal bodies like nuts or bolt heads. That is, the tips of each of the teeth of the jaws lie in a single plane.

The invention is not limited to wrenches where a threaded nut is used to adjust the gap between the jaws, as shown in FIGS. 1–2, but can be applied to all wrenches where two jaws can be located at different distance to grip and hold various sizes of pipes, tubes, shafts, bars and other round items.

What is claimed is:

1. A wrench for gripping round items, comprising:

a first shank and a second shank linked at a joint, said first shank being translatable relative to the joint;

each of said shanks including a toothed jaw, each of said toothed jaws extending at an angle of between 45–90 degrees from a longitudinal axis of said respective shanks, the tips of each of the teeth of each jaw lying in a single plane;

wherein a tooth height and distance between adjacent teeth increases from teeth nearest the longitudinal axis of a respective one of said first or second shanks to teeth farthest from the longitudinal axis of the respective one of said first or second shanks.

2. The wrench according to claim 1, wherein the distance between a largest one of said teeth and a tooth adjacent to said largest one of said teeth being at least 25% larger than the distance between said teeth which are smallest.

3. The wrench according to claim 1, wherein the distance between a largest one of said teeth and a tooth adjacent to said largest one of said teeth being between approximately 35–40% larger than the distance between said teeth which are smallest.

* * * * *